US008855505B2

(12) United States Patent
Yano

(10) Patent No.: US 8,855,505 B2
(45) Date of Patent: Oct. 7, 2014

(54) IMAGE STABILIZATION CONTROL SYSTEM AND IMAGE FORMING APPARATUS DIRECTED TO ELECTROPHOTOGRAPHIC PROCESS FOR MAINTAINING AND IMPROVING IMAGE QUALITY

(75) Inventor: So Yano, Ibaraki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 172 days.

(21) Appl. No.: 13/462,167

(22) Filed: May 2, 2012

(65) Prior Publication Data

US 2012/0294635 A1 Nov. 22, 2012

(30) Foreign Application Priority Data

May 18, 2011 (JP) ..... 2011-111373

(51) Int. Cl.
*G03G 15/20* (2006.01)
*G03G 15/01* (2006.01)
*G03G 15/00* (2006.01)

(52) U.S. Cl.
CPC .... *G03G 15/5062* (2013.01); *G03G 2215/0164* (2013.01); *G03G 2215/0132* (2013.01); *G03G 15/0189* (2013.01)
USPC ..... 399/15

(58) Field of Classification Search
USPC ..... 399/277, 15, 67, 69
See application file for complete search history.

(56) References Cited

U.S. PATENT DOCUMENTS

2012/0002992 A1 * 1/2012 Yamaguchi et al. ..... 399/49

FOREIGN PATENT DOCUMENTS

JP 2003315154 A * 11/2003
JP 2009-037138 A 2/2009

OTHER PUBLICATIONS

Translation of JP2003-315154A, Nov. 2003, to Sakatani et al.*

* cited by examiner

*Primary Examiner* — Quana M Grainger
(74) *Attorney, Agent, or Firm* — Buchanan Ingersoll & Rooney PC

(57) ABSTRACT

An image stabilization control system directed to an electrophotographic process is provided. The image stabilization control system includes a color measuring unit for measuring the color of a toner image after being fixed on a medium. The color measuring unit has an SCE color measuring function of measuring a component excluding specular reflection out of reflected light produced by light emitted from a light source being reflected at the toner image and an SCI color measuring function of measuring the reflected light including the specular reflection. A control value for a fixing step in the electrophotographic process is adjusted based on a first component attributed to a glossiness difference in chrominance, and a control value for a step other than the fixing step in the electrophotographic process is adjusted based on a second component attributed to another factor in the chrominance.

12 Claims, 8 Drawing Sheets

72a

SCE DATA

| | 10 | 20 | ・・・ |
|---|---|---|---|
| 1 | 2, 3 | 2, 4 | ・・・ |
| 2 | 4, 3 | 4, 5 | ・・・ |
| CALCULATED VALUE ・・・ | ・・・ | ・・・ | ◆ ◆ ◆ |

IMAGE STABILIZATION CONTROL SYSTEM AND IMAGE FORMING APPARATUS DIRECTED TO ELECTROPHOTOGRAPHIC PROCESS FOR MAINTAINING AND IMPROVING IMAGE QUALITY

This application is based on Japanese Patent Application No. 2011-111373 filed with the Japan Patent Office on May 18, 2011, the entire content of which is hereby incorporated by reference.

BACKGROUND OF THE INVENTION

1. Field of the Invention

The present invention relates to an image stabilization control system directed to an electrophotographic process, and an image forming apparatus having a function thereof.

2. Description of the Related Art

With recent technical progress in an electrophotographic process, the electrophotographic process is becoming applied to printing of published matters with a comparatively small circulation and the like, instead of conventional offset printing and gravure printing. An image forming apparatus suitable for such published matters may be particularly called a production printer.

The production printer using an electrophotographic process is advantageous in that making a printing plate (plate making) is not necessary unlike offset printing or gravure printing, and printing can easily be done only by transmitting print data to the production printer.

On the other hand, a printed matter obtained by the production printer might be inferior in image quality to offset printing. Accordingly, there is a need to improve the production printer to have image quality of the same level as that achieved by an offset printing press. It is noted that image quality offered by the offset printing press needs to attain "chrominance of $\Delta E00 \leq 1$" in the case of evaluation using "chrominance" which is a deviation from a target color.

To manage such image quality and to further improve image quality (image reproducibility), an attempt has been made to evaluate a printed matter using color measuring means to optimize the electrophotographic process. An image forming apparatus disclosed in Japanese Laid-Open Patent Publication No. 2009-037138, for example, has a structure of creating a color separation table from color measuring means, such as a color sensor built in a printer body.

To achieve image quality of the same level as that of an offset printing press, it is necessary to evaluate factors of chrominance produced in a printed matter in more detail. In conventional methods, however, there is no technique known which, upon separating chrominance producing factors, adjusts the electrophotographic process based thereon.

SUMMARY OF THE INVENTION

The present invention was made to solve the above problems, and has an object to provide an image stabilization control system for maintaining and improving image quality in an electrophotographic process, as well as an image forming apparatus having a function thereof.

An image stabilization control system directed to an electrophotographic process according to an aspect of the present invention includes a color measuring unit for measuring the color of a toner image after being fixed on a medium, and a control unit. The color measuring unit has an SCE color measuring function of measuring a component excluding specular reflection out of reflected light produced by light emitted from a light source being reflected at the toner image and an SCI color measuring function of measuring the reflected light including the specular reflection. The control unit includes a first calculation unit for obtaining a calculated value associated with glossiness in the toner image based on an SCI color measurement result obtained by the SCI color measuring function and an SCE color measurement result obtained by the SCE color measuring function, a second calculation unit for obtaining, from chrominance of the toner image relative to a predetermined reference value, a first component attributed to a glossiness difference in the chrominance and a second component attributed to another factor, based on at least one of the SCE color measurement result and the SCI color measurement result as well as the calculated value, and an adjusting unit for adjusting a control value for a fixing step in the electrophotographic process based on the first component, and adjusting a control value for a step other than the fixing step in the electrophotographic process based on the second component.

An image forming apparatus according to another aspect of the present invention includes an image processing unit for executing an electrophotographic process, a color measuring unit for measuring the color of a toner image after being fixed on a medium, and a control unit. The color measuring unit has an SCE color measuring function of measuring a component excluding specular reflection out of reflected light produced by light emitted from a light source being reflected at the toner image and an SCI color measuring function of measuring the reflected light including the specular reflection. The control unit includes a first calculation unit for obtaining a calculated value associated with glossiness in the toner image based on an SCI color measurement result obtained by the SCI color measuring function and an SCE color measurement result obtained by the SCE color measuring function, a second calculation unit for obtaining, from chrominance of the toner image relative to a predetermined reference value, a first component attributed to a glossiness difference in the chrominance and a second component attributed to another factor, based on at least one of the SCE color measurement result and the SCI color measurement result as well as the calculated value, and an adjusting unit for adjusting a control value for a fixing step in the electrophotographic process based on the first component, and adjusting a control value for a step other than the fixing step in the electrophotographic process based on the second component.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
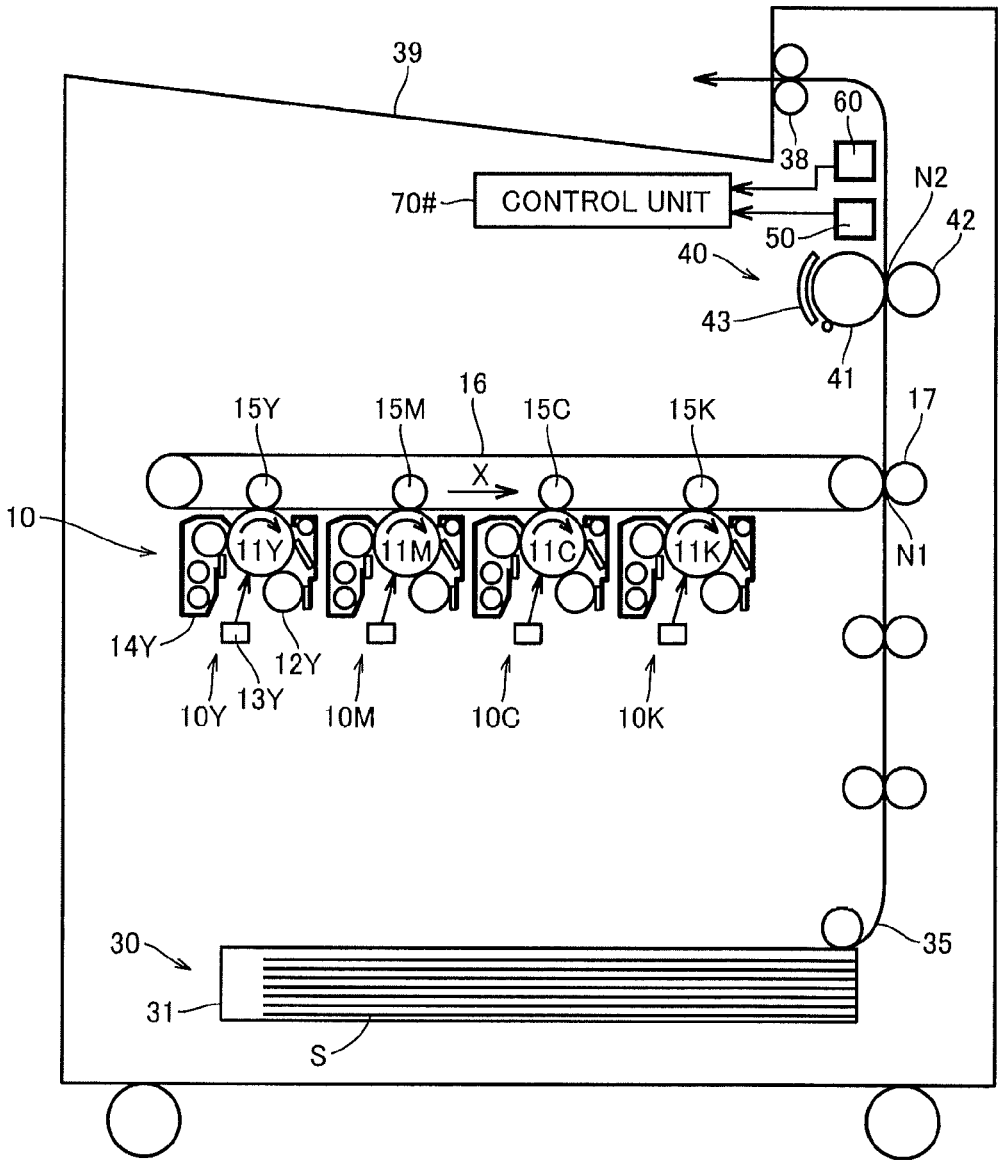
FIG. 1 is a schematic diagram showing the overall structure of an image forming apparatus related to the present embodiment.

An embodiment will be described in detail with reference to the drawings. It is noted that the same or corresponding parts in the drawings have the same reference characters allotted, and description thereof will not be repeated.

A. Outline

An image stabilization control system according to the present embodiment is directed to an electrophotographic process. This image stabilization control system has a color measuring unit for measuring the color of a toner image after being fixed on a medium (sheet) and a control unit. The control unit identifies chrominance producing factors using a color measurement result obtained by the color measuring unit.

The present embodiment is based on the knowledge that produced chrominance can be divided into at least two factors as follows:

(a) an error in "coloring" component produced by the presence of an error in the toner amount deposited on a sheet relative to a target deposit amount; and (b) an error in "glossiness" produced by variations in the fixing step (which occurs even when the toner amount deposited on a sheet presents a target value).

Feedback processing is performed for the electrophotographic process independently for these two factors that produce chrominance. More specifically, among factors of produced chrominance, a component attributed to the "glossiness" error is used for adjusting a control value for the fixing step in the electrophotographic process, and a component attributed to the "coloring" error is used for adjusting a control value for a step other than the fixing step in the electrophotographic process (specifically, any upstream steps including a secondary transfer step).

In this manner, by dividing the chrominance producing factors in the electrophotographic process into the component attributed to the "glossiness" error and a component attributed to the "coloring" error to clarify a step to be fed back, produced chrominance can be suppressed more properly.

Image quality of the same level as that of the offset printing press (produced chrominance: ΔE00≤1) can thereby be achieved in the electrophotographic process.

Hereinafter, an image stabilization control system according to the present embodiment and an image forming apparatus having a function thereof will be described with reference to the drawings and in comparison with a related structure.

B. Related Structure

Figure 2:
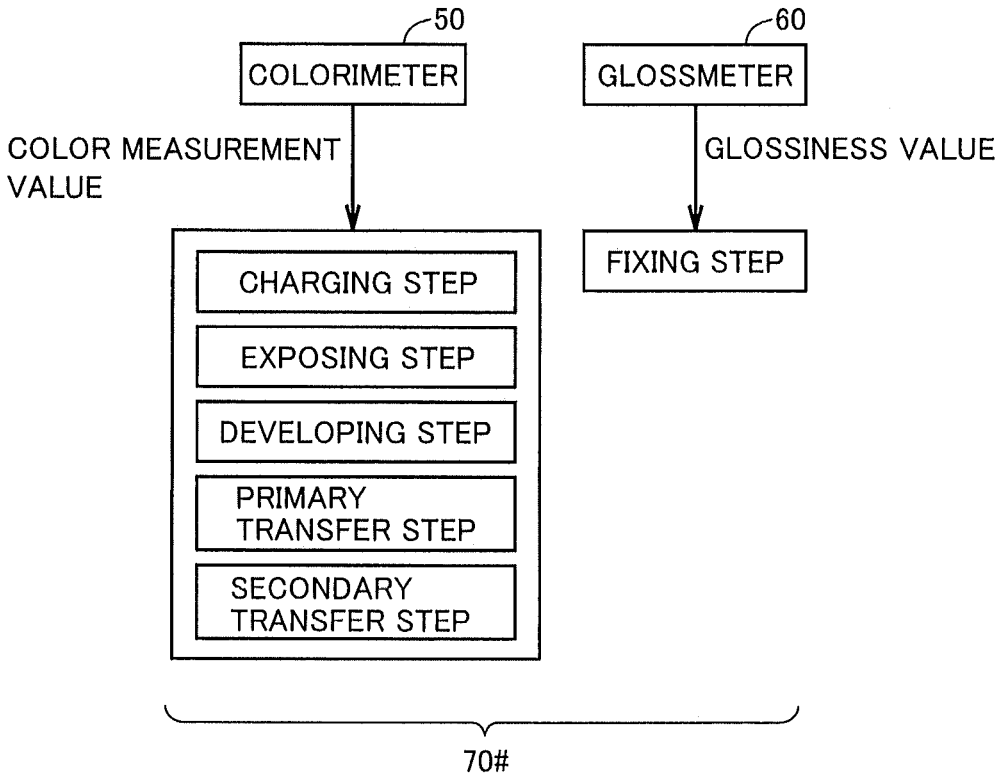
FIG. 2 is a block diagram in accordance with image stabilization control in the image forming apparatus shown in FIG. 1.

FIG. 1 is a schematic diagram showing the overall structure of an image forming apparatus related to the present embodiment. FIG. 2 is a block diagram in accordance with image stabilization control in the image forming apparatus shown in FIG. 1. FIG. 1 shows a tandem type color digital production printer (hereinafter also referred to as a "production printer") as a typical example of image forming apparatus.

Referring to FIG. 1, an image forming apparatus 1# related to the present embodiment forms an image using an electrophotographic system (electrophotographic process). Image forming apparatus 1# includes an image processing unit 10 for forming a toner image, a sheet transport unit 30 for transporting a medium (hereinafter also referred to as a "sheet S") onto which a toner image is transferred, a fixing device 40 for fixing the toner image transferred onto sheet S, a colorimeter 50 for measuring the color of the toner image after being fixed on sheet S, a glossmeter 60 for measuring the glossiness of the toner image after being fixed on sheet S, and a control unit 70# for receiving measured data obtained by colorimeter 50 and glossmeter 60. Control unit 70# has a function as an image stabilization control unit.

Upon receipt of an execution instruction of a print job from an external terminal device (not shown) connected to a network (typically, LAN (Local Area Network)), for example, image forming apparatus 1# forms a color toner image of respective colors of yellow (Y), magenta (M), cyan (C), and black (K) on sheet S based on the instruction.

Image processing unit 10 includes image forming units 10Y, 10M, 10C, and 10K as well as an intermediate transfer belt 16 to which respective toner images formed by image forming units 10Y, 10M, 10C, and 10K are transferred. Image forming units 10Y, 10M, 10C, and 10K form monochrome toner images of colors of Y, M, C, and K, respectively, and these monochrome toner images are sequentially superimposed by means of intermediate transfer belt 16.

Intermediate transfer belt 16 extends horizontally at a substantially middle position in the vertical direction of image forming apparatus 1#, and revolves in the direction indicated by an arrow X. Below a revolving area of intermediate transfer belt 16, image forming units 10Y, 10M, 10C, and 10K are arranged in the order presented in the revolving direction of intermediate transfer belt 16.

Image forming unit 10Y forming a toner image with toner of Y color has a photoconductor drum 11Y as well as a charger 12Y, an exposing unit 13Y and a developer 14Y provided therearound. Image forming unit 10Y sequentially experiences a charging step, an exposing step and a developing step to form a toner image of Y color on photoconductor drum 11Y. Other image forming units 10M, 10C and 10K have a similar structure as image forming unit 10Y, and toner images of M, C and K colors are formed on photoconductor drums 11M, 11C and 11K, respectively. The respective toner images formed on photoconductor drums 11Y, 11M, 11C, and 11K are multilayer-transferred to the same transfer region on intermediate transfer belt 16 by means of primary transfer rollers 15Y, 15M, 15C, and 15K arranged opposite to photoconductor drums 11Y, 11M, 11C, and 11K, respectively, with intermediate transfer belt 16 interposed therebetween. At one end of intermediate transfer belt 16 in proximity to image forming unit 10K, secondary transfer roller 17 is arranged opposite to intermediate transfer belt 16, and a transfer nip N1 is created therebetween.

Sheet transport unit 30 has a sheet paper cassette 31 provided in a lower part of image processing unit 10. At the time of execution of a print job, sheet transport unit 30 sends sheets S stored in sheet paper cassette 31 one by one to a transport path 35 passing through transfer nip N1 between intermediate transfer belt 16 and secondary transfer roller 17. Toner images multilayer-transferred to intermediate transfer belt 16 are collectively transferred onto sheet S sent out to transport path 35 while sheet S is passing through transfer nip N1, and sheet S is transported to fixing device 40 provided above transfer nip N1. Fixing device 40 heats sheet S being transported along path 35 by an electromagnetic induction heating system, and presses toner images against sheet S, thereby fixing the toner images onto sheet S. Sheet S after fixing is ejected onto an ejecting tray 39 by a pair of paper ejecting rollers 38.

Fixing device 40 includes a heating roller 41 as a first rotor, a pressure roller 42 as a second rotor and an electromagnetic induction coil 43 for heating roller 41. Heating roller 41 and pressure roller 42 each have axially opposite ends being supported by a frame not shown with a bearing component or the like interposed therebetween so as to be freely rotatable, and heating roller 41 and pressure roller 42 are pressed against each other, so that a fixation nip N2 through which sheet S passes is created.

Colorimeter 50 measures the color of sheet S, and glossmeter 60 measures the glossiness of sheet S. Colorimeter 50 outputs a measured color measurement value to control unit 70#, and glossmeter 60 outputs measured glossiness to control unit 70#. Control unit 70# performs image stabilization control based on these measurement values.

Referring to FIG. 2, control unit 70# performs feedback processing for adjusting a control value for each step of the charging step, the exposing step, the developing step, the primary transfer step, and the secondary transfer step based on the color measurement value received from colorimeter 50. Control unit 70# also performs feedback processing for adjusting a control value for the fixing step based on the glossiness received from glossmeter 60, independently of the feedback processing based on the color measurement value received from colorimeter 50.

In this manner, in the image forming apparatus related to the present embodiment, colorimeter 50 and glossmeter 60 are provided independently of each other, and the measurement results obtained respectively are used for feedback processing independently of each other.

C. Subjects in Related Structure (c1: Subject 1)

As described above, to correctly divide chrominance producing factors in the electrophotographic process into the component attributed to the "glossiness" error and the component attributed to the "coloring" error, at least conditions (1) to (3) as follows need to be simultaneously satisfied:

(1) detection accuracy of colorimeter 50: $\Delta E00 \leq 0.1$ (including a temperature property correction error);

(2) glossiness detection accuracy of glossmeter 60: 0.3 or less (equivalent to $\Delta E00=0.1$) (including a temperature property correction error); and (3) detection accuracy of both colorimeter 50 and glossmeter 60: $\Delta E00 \leq 0.1$ (including a temperature property correction error).

In contrast, image forming apparatus 1# shown in FIG. 1 has independently mounted thereon a sensor for measuring the color and a sensor for measuring the glossiness of a toner image after being fixed onto sheet S. When such a structure is adopted, colorimeter 50 including the sensor for color measurement and a light source as well as glossmeter 60 including the sensor for glossiness measurement and a light source are provided independently of each other. In this manner, the pairs of light source and detection unit exist independently of each other, which are likely to be affected by variations in property due to temperature variations, and the like. Although it is realistically possible to satisfy the above-mentioned conditions (1) and (2) by conducting temperature property correction appropriately for each sensor, it is difficult to satisfy the above-mentioned condition (3). Even if the above-mentioned condition (3) can be satisfied, it will be necessary to adopt a highly accurate sensor, which is not realistic in terms of cost.

(c2: Subject 2)

Further, it is insufficient for achieving image stabilization control merely by satisfying the above-mentioned condition (3). This is because, as shown in FIG. 2, in image stabilization control in the image forming apparatus related to the present embodiment, feedback processing is directly performed such that each of the charging step, the exposing step, the developing step, the primary transfer step, and the secondary transfer step is optimized based on the color measurement value received from colorimeter 50, and feedback processing is directly performed such that the fixing step is optimized based on the color measurement value received from colorimeter 50. In this manner, each feedback processing is executed independently such that a corresponding step is optimized, and there exists no function of managing and checking image stabilization control as a whole. That is, image stabilization control is not always optimized as a whole, and it is difficult to attain target chrominance of $\Delta E00 \leq 1$ as a result of print on a sheet.

The image stabilization control system according to the present embodiment and the image forming apparatus having a function thereof have an object to solve these subjects.

D. Device Structure According to the Present Embodiment

Figure 3:
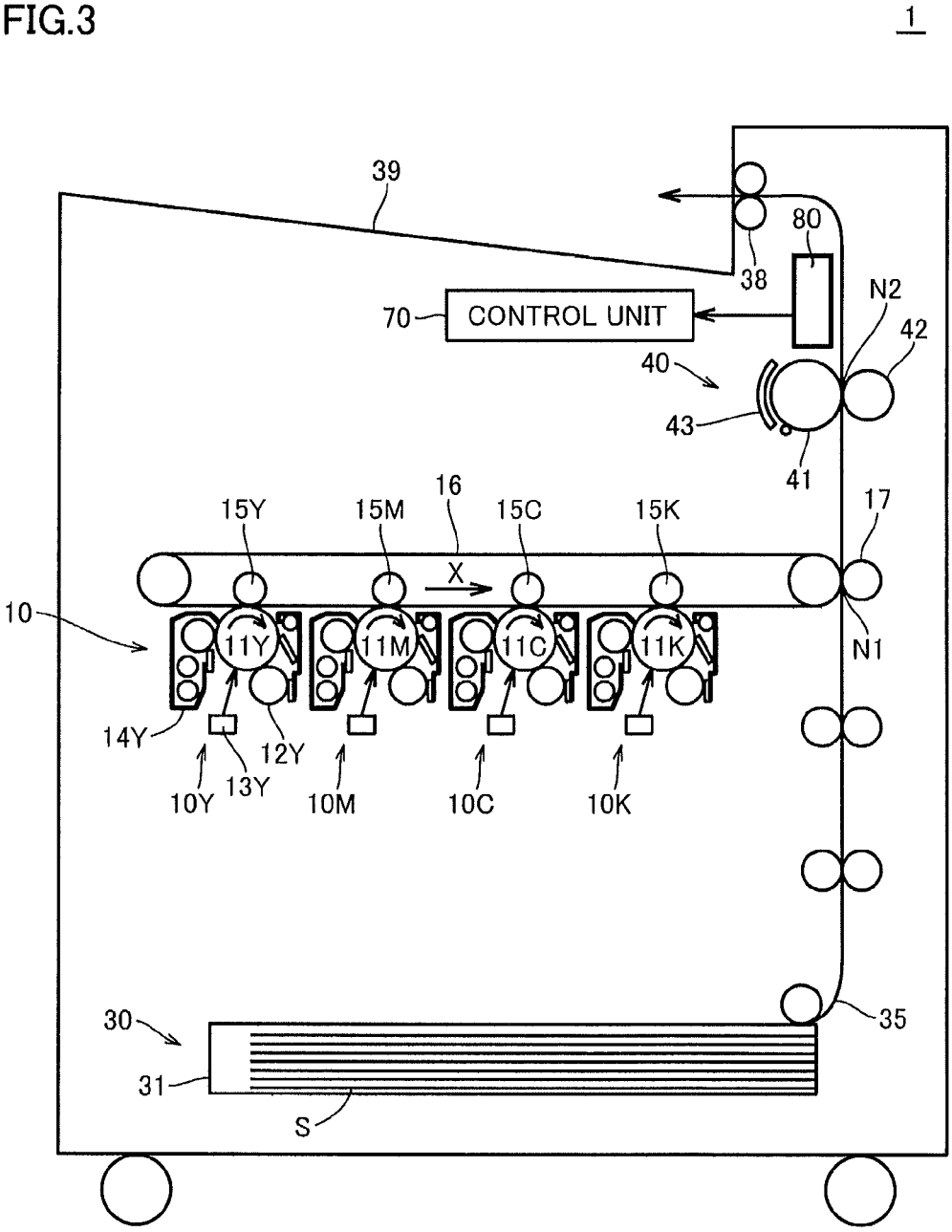
FIG. 3 is a schematic diagram showing the overall structure of an image forming apparatus in accordance with the present embodiment.

FIG. 3 is a schematic diagram showing the overall structure of an image forming apparatus 1 according to the present embodiment. Referring to FIG. 3, image forming apparatus 1 according to the present embodiment differs from image forming apparatus 1# shown in FIG. 1 in that a colorimeter 80 is provided instead of colorimeter 50 and glossmeter 60. In addition, image forming apparatus 1 according to the present embodiment is provided with a control unit 70 for performing image stabilization control upon receipt of a measurement result obtained by colorimeter 80.

Colorimeter 80 corresponds to a color measuring unit for measuring the color of an image (toner image) after being fixed on sheet S. Particularly, colorimeter 80 according to the present embodiment has an SCE (Specular reflection Component Excluded) color measuring function of measuring a component excluding specular reflection out of reflected light produced by light emitted from a light source being reflected at the toner image and an SCI (Specular reflection Component included) color measuring function of measuring that reflected light including specular reflection. As a form of such colorimeter 80 having the SCI color measuring function and the SCE color measuring function, a structure using an integrating sphere is adopted in the present embodiment. Specifically, colorimeter 80 is a colorimeter in which an integrating sphere is used, and performs color measurement on sheet S in two measuring modes of SCI (specular reflection included) and SCE (specular reflection excluded) by varying geometric conditions of illumination and light reception. The respective measurement results in these two measuring modes are transmitted to control unit 70, and are used for image stabilization control.

Figure 4:
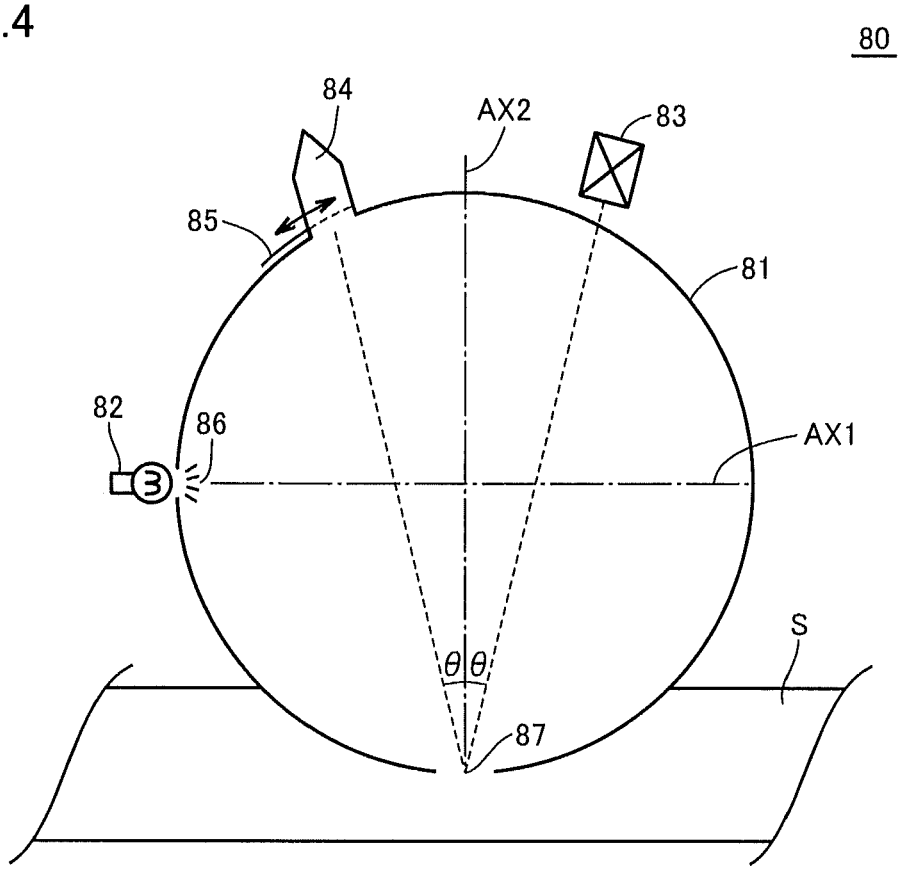
FIG. 4 is a schematic diagram showing the overall structure of a colorimeter shown in FIG. 3.

FIG. 4 is a schematic diagram showing the overall structure of colorimeter 80 shown in FIG. 3. Referring to FIG. 4, colorimeter 80 includes an integrating sphere 81, a light source 82 for generating illumination light, and a detection unit 83 for detecting illuminance at the inner surface of integrating sphere 81. A diffuse reflective agent, such as barium sulfate, is applied to the inner surface of integrating sphere 81, and light entered the inside thereof repeats diffuse reflection at the inner surface. Then, illuminance depending on the light amount of incident light appears at the inner surface of integrating sphere 81. By detecting the illuminance at the inner surface of this integrating sphere 81, the light amount of light entered the integrating sphere and the like can be measured.

More specifically, integrating sphere 81 has formed therein an opening 87 communicating with sheet S as a medium with a toner image fixed thereon and an opening 86 communicating with light source 82. At the time of color measurement by colorimeter 80, light source 82 emits illumination light to the inner surface of integrating sphere 81 with opening 87 positioned to be in contact the surface of sheet S. Opening 86 is formed at such a position that the illumination light from associated light source 82 propagates along an optical axis AX1 parallel to sheet S. After repeatedly reflected at the inner surface of integrating sphere 81, this illumination light enters a measurement plane of sheet S (opening 87). In principle, light enters sheet S in every direction from integrating sphere 81 side. Light reflected at the measurement plane of this sheet S is again repeatedly reflected at the inner surface of integrating sphere 81, and a portion thereof enters detection unit 83.

Since it is necessary in the SCE color measuring function mentioned above to prevent the light specularly reflected at the measurement plane of sheet S from directly entering detection unit 83, integrating sphere 81 is provided with a blocking unit for preventing the specular reflection produced within integrating sphere 81 from entering detection unit 83. Specifically, a light trap 84 is provided at a position symmetrical with the axis of detection of detection unit 83 with respect to an optical axis AX2 perpendicular to sheet S. That is, colorimeter 80 includes light trap 84 arranged on an optical axis produced by the light emitted from light source 82 being specularly reflected at sheet S located at opening 87, as the blocking unit for preventing the specular reflection produced within integrating sphere 81 from entering detection unit 83. Light trap 84 is an optical element that absorbs light entered the inside thereof. That is, reflected light does not occur from the region of the inner surface of integrating sphere 81 where light trap 84 is provided. Therefore, in principle, propagation of light does not occur on an optical path from light trap 84 to detection unit 83 arranged symmetrically at an incident angle θ with respect to the measurement plane (opening 87) of sheet S.

Further, colorimeter 80 according to the present embodiment includes a switching unit for switching between causing light to enter light trap 84 and causing light to be reflected in order to select between the SCI measurement mode and the SCE measurement mode. More specifically, a slide cover 85 is provided movably at an incident opening of light trap 84. A diffuse reflective agent similar to the diffuse reflective agent applied to the inner surface of integrating sphere 81 is applied to the surface of slide cover 85 (on the inner surface side of integrating sphere 81). The closed state of slide cover 85 (covering the incident opening of light trap 84) substantially corresponds to the state where light trap 84 does not exist. In the open state of slide cover 85 (not covering the incident opening of light trap 84), light trap 84 exerts an essential function.

In this manner, the SCI measurement and the SCE measurement are performed by switching slide cover 85 between the open and closed states.

Referring to FIG. 3 again, control unit 70 receives an SCI color measurement result (hereinafter also referred to as "SCI data") and an SCE color measurement result (hereinafter also referred to as "SCE data") measured by the above-described colorimeter 80, and performs feedback processing for the electrophotographic process using these color measurement results, thereby achieving image quality comparable to that of the offset printing press.

Control unit 70 includes, as its main components, a CPU (Central Processing Unit) for executing a program code in a predetermined sequence, a RAM (Random Access Memory) for providing a working region necessary for execution of the program code, a ROM (Read Only Memory) for providing the program code, and the like. Further, all or part of control unit 70 may be implemented by hardware, such as ASIC (Application Specific Integrated Circuit) or FPGA (Field-Programmable Gate Array).

E. Functions in Control Unit

Figure 5:
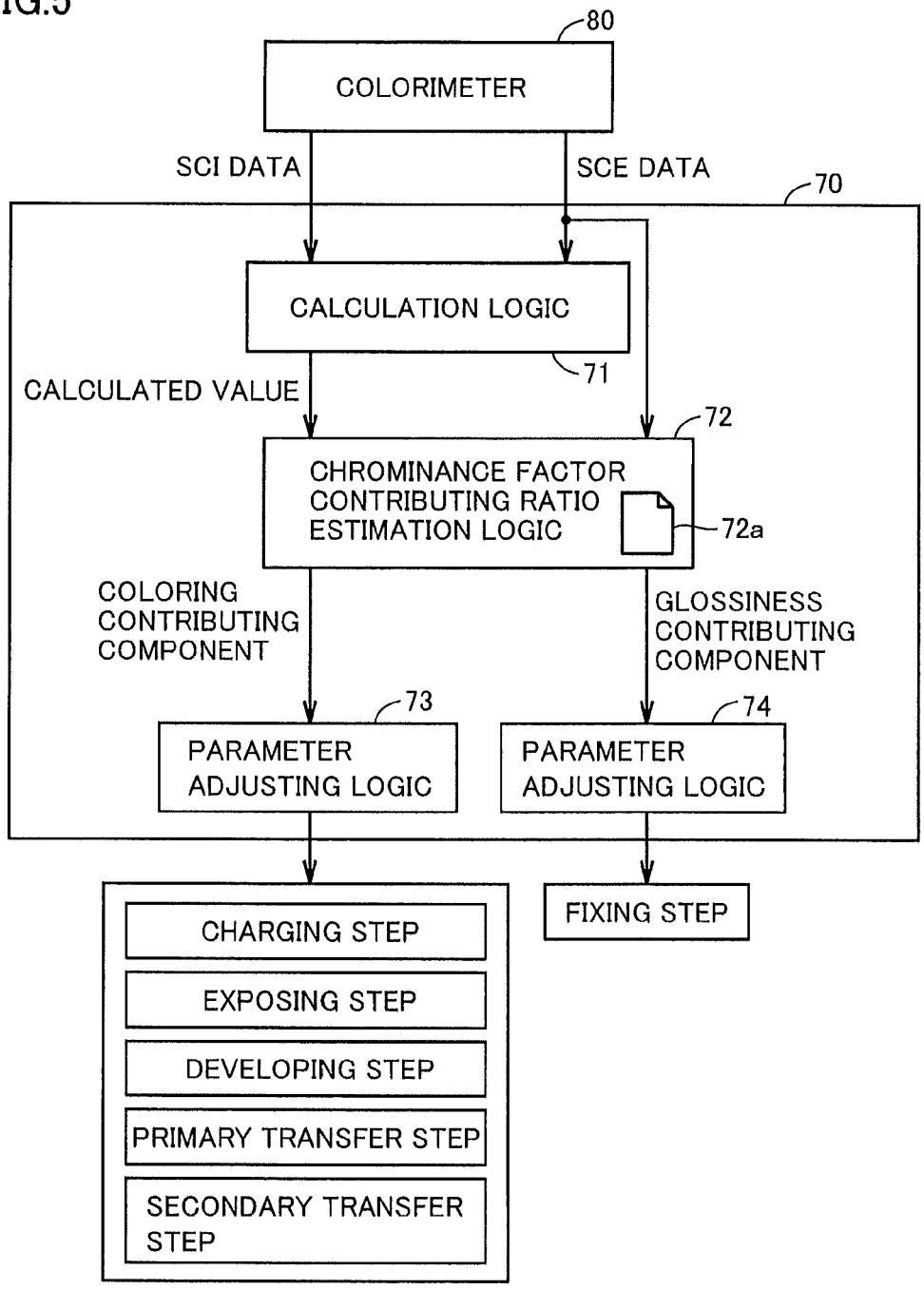
FIG. 5 is a block diagram in accordance with image stabilization control in the image forming apparatus shown in FIG. 3.

Functions and control logics in control unit 70 will now be described. FIG. 5 is a block diagram according to image stabilization control in image forming apparatus 1 shown in FIG. 3.

Referring to FIG. 5, control unit 70 receives the SCI data and the SCE data measured by colorimeter 80, and performs feedback processing for the electrophotographic process based on information acquired as a result of execution of predetermined calculating operations.

The present embodiment estimates chrominance producing factors by separating them at least into (a) the "coloring" error component produced by the presence of an error in the toner amount deposited on a sheet relative to a target deposit amount (hereinafter also referred to as "a coloring contributing component") and (b) the "glossiness" error produced by variations in the fixing step (hereinafter also referred to as "a glossiness contributing component"). Control unit 70 adjusts control values (parameters) for the steps following control of the toner deposit amount in the electrophotographic process (specifically, the charging step, the exposing step, the developing step, the primary transfer step, and the secondary transfer step) based on the calculated coloring contributing component. In parallel to this, control unit 70 adjusts a control value (parameter) for the step following glossiness control of a toner image in the electrophotographic process (specifically, the fixing step) based on the calculated glossiness contributing component.

More specifically, control unit 70 includes a calculation logic 71, a chrominance factor contributing ratio estimation logic 72, and parameter adjusting logics 73, 74.

Calculation logic 71 obtains a calculated value associated with glossiness in a toner image based on the SCI color measurement result (SCI data) obtained by the SCI color measuring function and the SCE color measurement result (SCE data) obtained by the SCE color measuring function. More specifically, calculation logic 71 obtains a calculated value from the difference between the SCE color measurement result (SCE data) and the SCI color measurement result (SCI data). For example, JIS (Japanese Industrial Standards) and the like define "glossiness" as being calculated based on the magnitude of a specular reflection component detected when a predetermined amount of light is radiated at a predetermined incident angle. That is, when a toner image changes in glossiness, the reflection intensity from that toner image changes accordingly. The magnitude of such specular reflection can easily be detected by observing the difference between the SCE data and the SCI data. Then, control unit 70 according to the present embodiment obtains the difference between the SCE data and the SCI data as a calculated value correlated with glossiness.

On the other hand, when a toner image changes in color due to a glossiness error, an error in toner deposit amount or the like so that chrominance occurs, the reflection intensity in that toner image changes. With this change in reflection intensity, the amount of light produced within integrating sphere 81 also changes. This change in amount of light will mainly be reflected on the SCE data. That is, the SCE data is a value associated with produced chrominance.

Chrominance factor contributing ratio estimation logic 72 calculates the glossiness contributing component and the coloring contributing component separately using the calculated value correlated with glossiness and the SCE data correlated with produced chrominance. That is, chrominance factor contributing ratio estimation logic 72 calculates, from chrominance of the toner image relative to a predetermined reference value, a first component (glossiness contributing component) attributed to a glossiness difference in the chrominance and a second component (coloring contributing component) attributed to another factor, based on at least one of the SCE color measurement result (SCE data) and the SCI color measurement result (SCI data) as well as the calculated value.

As the method of calculating the coloring contributing component and the glossiness contributing component in chrominance factor contributing ratio estimation logic 72, various methods can be adopted, however, a method of referring to a look-up table (LUT) 72*a* prepared previously may be adopted as an example.

Figures 6, 7:
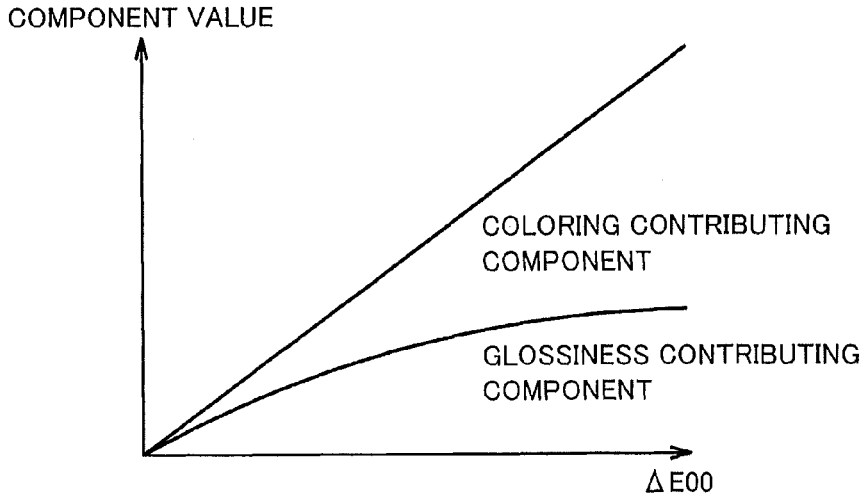
FIG. 6 shows an example of relationship of chrominance ΔE00 to a coloring contributing component and a glossiness contributing component.
FIG. 7 shows an example of a look-up table for calculating the coloring contributing component and the glossiness contributing component.

FIG. 6 shows an example of relationship of chrominance ΔE00 to the coloring contributing component and the glossiness contributing component. FIG. 7 shows an example of look-up table 72*a* for calculating the coloring contributing component and the glossiness contributing component.

Referring to FIG. 6, as produced chrominance ΔE00 increases, for example, the coloring contributing component and the glossiness contributing component increase in accordance with their properties. Referring to FIG. 7, look-up table 72*a* accepting SCE data and calculated values as input values can be formed by previously acquiring such properties experimentally. This look-up table 72*a* has two-dimensional values (glossiness contributing component and coloring contributing component) defined in correspondence with the respective positions of SCE data and calculated values having been input. When SCE data and calculated values are input, chrominance factor contributing ratio estimation logic 72 determines the magnitude of the glossiness contributing component and the coloring contributing component referring to look-up table 72*a*.

Parameter adjusting logics 73, 74 adjust process parameters for the respective steps included in the electrophotographic process based on the coloring contributing component and the glossiness contributing component calculated by chrominance factor contributing ratio estimation logic 72. That is, parameter adjusting logic 74 adjusts control values for the fixing step in the electrophotographic process based on the glossiness contributing component, and parameter adjusting logic 73 adjusts control values for steps other than the fixing step in the electrophotographic process based on the coloring contributing component.

More specifically, in feedback processing for the fixing step based on the glossiness contributing component, at least one set value of a fixing temperature, a fixing pressure and a nip width, for example, among process parameters for the fixing step is changed based on the glossiness contributing component. By adjusting such a process parameter for the fixing step and then executing printing processing, chrominance attributed to a "glossiness" error can be improved. Parameter adjusting logic 74 adjusts process parameters for the fixing step.

On the other hand, in feedback processing for the fixing step based on the coloring contributing component, a set value for at least one of the charging step, the exposing step, the developing step, and the transfer step is changed based on the coloring contributing component. When adjusting process parameters for the primary transfer step and/or secondary transfer step, for example, a transfer current and/or a transfer voltage are/is targeted. When adjusting process parameters for the exposing step and/or the developing step, a laser intensity and/or an image processing set value are/is targeted. When adjusting a process parameter for the charging step, a charging voltage is targeted. By adjusting process parameters for such steps upstream of the fixing step and then executing printing processing, chrominance attributed to the "coloring" error can be improved. Parameter adjusting logic 73 adjusts process parameters for such upstream steps (the charging step, the exposing step, the developing step, and the transfer step).

The above description has addressed exemplary processing of obtaining a calculated value associated with glossiness from the difference between the SCI data and the SCE data, however, instead of or in addition to a subtraction operation for calculating the difference, a calculating operation and/or a LUT operation or the like in accordance with the process may be provided.

In addition, although the above description has illustrated the processing of separating the chrominance producing factors using the calculated value obtained from the difference between the SCI data and the SCE data as well as the SCE data, the chrominance producing factors may be divided using the combination of the calculated value and the SCI data, or the combination of the calculated value, the SCI data and the SCE data.

It is noted that the above description has shown the example of color measurement conducted only by colorimeter 80 in which the integrating sphere is used, however, color measurement may be performed further in combination with an image sensor, such as a line sensor, in addition to colorimeter 80.

F. Procedure

A procedure in the image stabilization control system according to the present embodiment will now be described.

Figure 8:
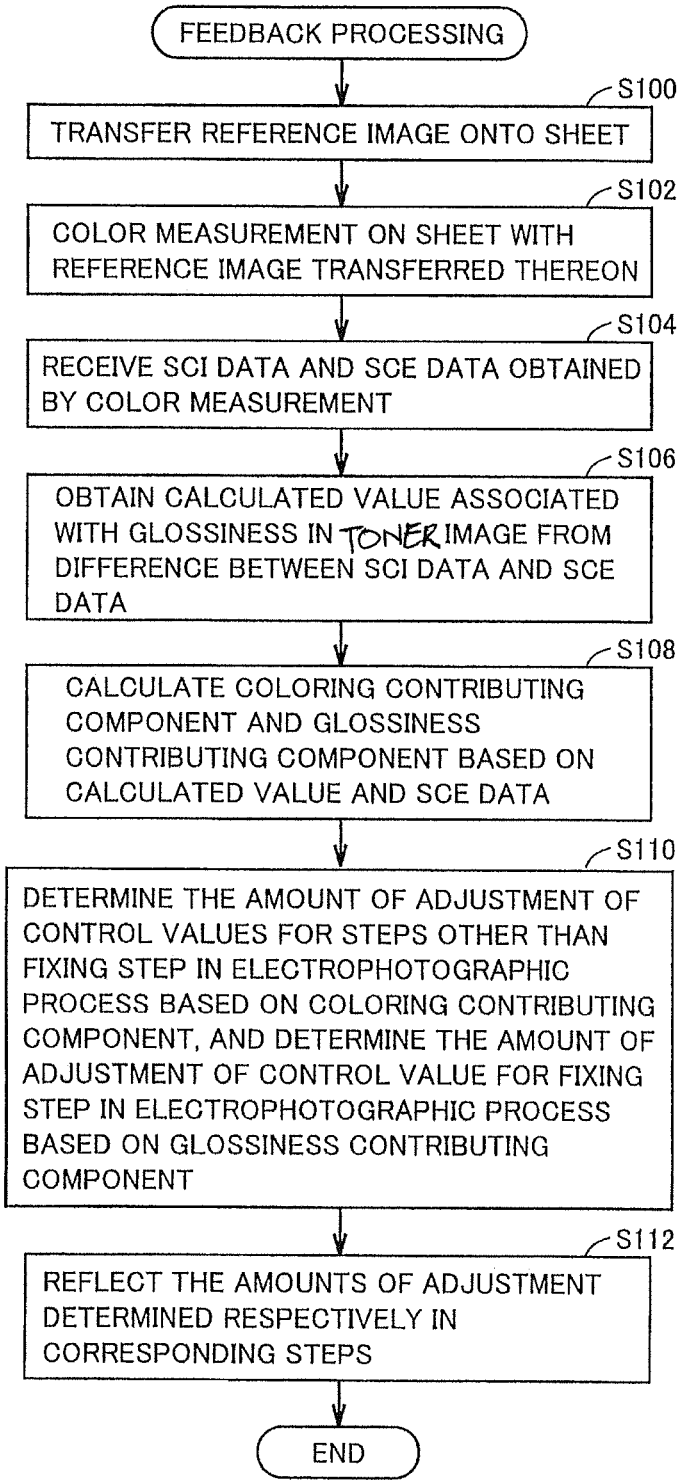
FIG. 8 is a flow chart showing a procedure in the image stabilization control system according to the present embodiment.

FIG. 8 is a flow chart showing a procedure in the image stabilization control system according to the present embodiment. Each step shown in FIG. 8 is mainly executed by control unit 70.

Referring to FIG. 8, control unit 70 provides a command to image processing unit 10, to thereby transfer a reference image for evaluating chrominance onto sheet S (Step S100). Then, control unit 70 provides a command to colorimeter 80, to thereby perform color measurement on sheet S with the reference image transferred thereon in Step S100 (Step S102). It is noted that, as described with reference to FIG. 4, the SCI measurement and the SCE measurement are performed by opening/closing slide cover 85 provided at the incident opening of light trap 84.

Figure 9:
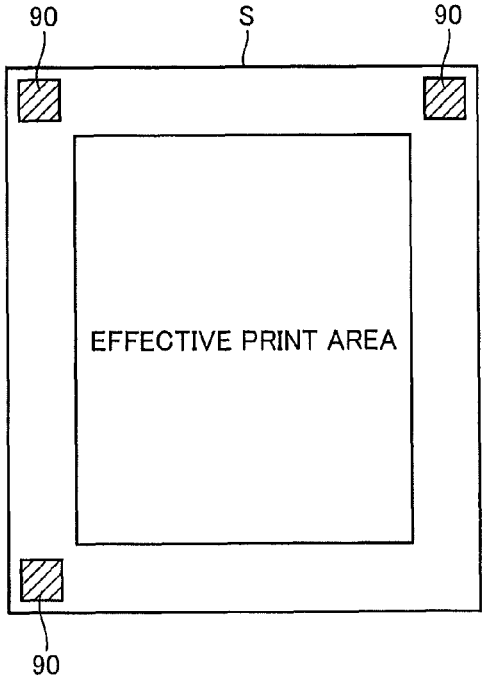
FIG. 9 shows an example of a patch for color measurement in the image stabilization control system according to the present embodiment.

FIG. 9 shows an example of a patch for measuring the color in the image stabilization control system according to the present embodiment. It is preferable that the reference image transferred onto sheet S in Step S102 be formed as a patch as shown in FIG. 9. Particularly when applied to a production printer, the circumference of sheet S is often cut for bookbinding. Thus, by printing a patch on this portion to be cut, color measurement and feedback control can be performed for every print. Adopting such a configuration eliminates the necessity to perform excessive processing such as printing a toner image on sheet S only for color measurement.

Referring to FIG. 8 again, control unit 70 receives the SCI data and SCE data acquired by the color measurement in Step S102 from colorimeter 80 (Step S104). Then, control unit 70 obtains a calculated value associated with glossiness in a toner image from the difference between the SCI data and the SCE data received in Step S104 (Step S106). Further, control unit 70 calculates a coloring contributing component and a glossiness contributing component based on the calculated value obtained in Step S106 and the SCE data received in Step S104 (Step S108). Then, control unit 70 determines the amount of adjustment of control values for the steps other than the fixing step in the electrophotographic process (the charging step, the exposing step, the developing step, the primary transfer step, and the secondary transfer step) based on the coloring contributing component calculated in Step S108, and determines the amount of adjustment of control values for the fixing step in the electrophotographic process based on the glossiness contributing component (Step S110).

Finally, control unit 70 reflects the amounts of adjustment respectively determined in Step S110 in the corresponding steps (Step S112). Then, the flow for a single feedback process is terminated.

G. Network Configuration

The above description has illustrated image forming apparatus 1 having the function of the image stabilization control system according to the present embodiment, however, when a plurality of image forming apparatuses exist, a common image stabilization control system may be built for these plurality of image forming apparatuses.

Figure 10:
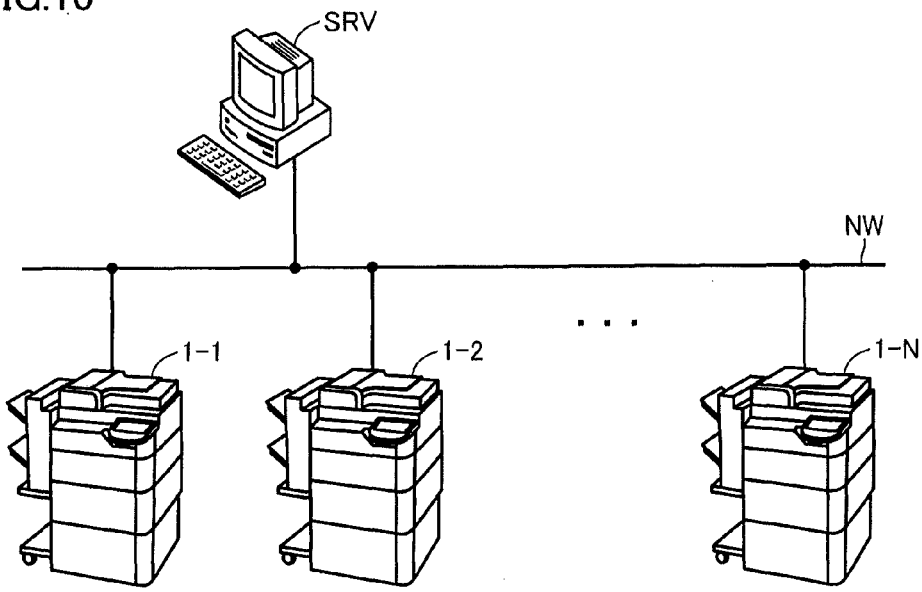
FIG. 10 is a schematic diagram showing an exemplary configuration of an image stabilization control system according to another embodiment.

FIG. 10 is a schematic diagram showing an exemplary configuration of an image stabilization control system according to another embodiment. Referring to FIG. 10, a plurality of image forming apparatuses 1-1, 1-2, . . . , 1-N are connected to a common network NW, and a server device SRV having a function corresponding to the image stabilization control system is also connected to network NW.

Server device SRV has the respective logics provided by control unit 70 shown in FIG. 5, and executes these logics for each of image forming apparatuses 1-1, 1-2, . . . , 1-N connected. Accordingly, each of image forming apparatuses 1-1, 1-2, . . . , 1-N transmits SCI data and SCE data measured by colorimeter 80 to server device SRV, and server device SRV executes processing as described above based on the SCI data and the SCE data received from each image forming apparatus and provides each image forming apparatus with a command on the amounts of adjustment necessary for feedback processing and the like.

By adopting the network configuration as shown in FIG. 10, the cost can be reduced because logic portions related to feedback processing in each of image forming apparatuses 1-1, 1-2, . . . , 1-N can be omitted, while the efficiency in cost and effort in maintenance management can be increased because data related to feedback processing (such as look-up table 72*a* shown in FIG. 7) can be managed in common.

H. Variation

Although the above-described embodiment has illustrated the structure in which heating roller 41 with the electromagnetic induction heat generation layer formed thereon is used as a first rotor, it is not limited to such a structure, but a fixing belt with the electromagnetic induction heat generation layer formed thereon may be used instead of heating roller 41. When using the fixing belt, control at high speeds is required because the heat capacity is small. Control at high speeds can be achieved by applying the control logics according to the present embodiment. Alternatively, a structure may be adopted in which a pressure belt is used instead of the pressure roller.

Although the above-described embodiment has illustrated the tandem type color digital production printer as a typical example of image forming apparatus, it is not limited to this, but it may be either a color image forming apparatus or a monochrome image forming apparatus, and further may be a copying machine, a facsimile or MFP (Multi-Functional Peripheral) apparatus.

I. Another Embodiment

The image stabilization control system according to the present embodiment includes the following aspects.

An image stabilization control system according to a first aspect includes a color measuring unit and an image stabilization control unit. The color measuring unit has an SCI (specular reflection included) color measuring unit and an SCE (specular reflection excluded) color measuring unit that use an integrating sphere for illumination and light reception. The image stabilization control unit includes a subtraction unit for performing a subtraction using an SCI measurement value and an SCE measurement value obtained by the color measuring unit, a LUT calculation unit for performing a calculation on the result of subtraction obtained by the subtraction unit, and a factor contributing ratio estimation unit for estimating factors of produced chrominance and their contributing ratios from the calculation result obtained by the LUT calculation unit and the SCE measurement value. Then, a contributing ratio attributed to glossiness in the determination result obtained by the factor contributing ratio estimation unit is fed back to the fixing step, and a contributing ratio not attributed to glossiness is fed back to a step other than the fixing step.

An image stabilization control system according to a second aspect includes a color measuring unit and an image stabilization control unit. The color measuring unit has an SCI (specular reflection included) color measuring unit and an SCE (specular reflection excluded) color measuring unit that use an integrating sphere for illumination and light reception. The image stabilization control unit includes a subtraction unit for performing a subtraction using an SCI measurement value and an SCE measurement value obtained by the color measuring unit, a LUT calculation unit for performing a calculation on the result of subtraction obtained by the subtraction unit, and a factor contributing ratio estimation unit for estimating factors of produced chrominance and their contributing ratios from the calculation result obtained by the LUT calculation unit and the SCI measurement value. Then, a contributing ratio attributed to glossiness in the determination result obtained by the factor contributing ratio estimation unit is fed back to the fixing step, and a contributing ratio not attributed to glossiness is fed back to a step other than the fixing step.

An image stabilization control system according to a third aspect includes a color measuring unit and an image stabilization control unit. The color measuring unit has an SCI (specular reflection included) color measuring unit and an SCE (specular reflection excluded) color measuring unit that use an integrating sphere for illumination and light reception. The image stabilization control unit includes a subtraction unit for performing a subtraction using an SCI measurement value and an SCE measurement value obtained by the color measuring unit, a LUT calculation unit for performing a calculation on the result of subtraction obtained by the subtraction unit, and a factor contributing ratio estimation unit for estimating factors of produced chrominance and their contributing ratios from the calculation result obtained by the LUT calculation unit, the SCI measurement value and the SCE measurement value. Then, a contributing ratio attributed to glossiness in the determination result obtained by the factor contributing ratio estimation unit is fed back to the fixing step, and a contributing ratio not attributed to glossiness is fed back to a step other than the fixing step.

J. Advantage

According to the present embodiment, the color of an image on sheet S is measured using colorimeter 80 in which an integrating sphere is used under geometric conditions of illumination and light reception in two modes of SCI (specular reflection included) and SCE (specular reflection excluded), and SCI data and SCE data are transmitted to control unit 70. Control unit 70 obtains a calculated value correlated with glossiness from the SCI data and the SCE data in accordance with a subtraction and/or another necessary operation. The calculated value correlated with glossiness can thereby be obtained from the color measurement result, without providing a gloss sensor separately. That is, by conducting temperature property correction on colorimeter 80, the correction accuracy can be ensured between color measurement values (SCI data and SCE data) and a value (calculated value) correlated with glossiness.

In addition, control unit 70 divides the chrominance producing factors on sheet S into "coloring" and "glossiness difference" from the SCE data and the calculated value, and performs feedback processing depending on each contributing ratio. Further, color measurement is performed on sheet S printed after feedback processing, and the effect of previous feedback processing is checked similarly from the SCE data and the calculated value, and if needed, correction feedback processing is further performed. Control unit 70 checks the effect of feedback processing by collectively managing color measurement values (SCI data and SCE data) and calculated values, and if needed, further performs correction feedback processing.

By applying such two solutions, the following conditions (1) to (3) necessary for correctly dividing the chrominance producing factors into "glossiness difference" and "coloring" can be fulfilled:

(1) detection accuracy of colorimeter: $\Delta E00 \leq 0.1$ (including a temperature property correction error);

(2) glossiness detection accuracy of glossmeter: 0.3 or less (corresponding to $\Delta E00=0.1$) (including a temperature property correction error); and (3) detection accuracy of both colorimeter and glossmeter: $\Delta E00 \leq 0.1$ (including a temperature property correction error).

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image stabilization control system directed to an electrophotographic process, comprising:

a color measuring unit for measuring the color of a toner image after being fixed on a medium; and a control unit, wherein said color measuring unit has an SCE color measuring function of measuring a component excluding specular reflection out of reflected light produced by light emitted from a light source being reflected at said toner image and an SCI color measuring function of measuring said reflected light including said specular reflection, and said control unit includes a first calculation unit for obtaining a calculated value associated with glossiness in said toner image based on an SCI color measurement result obtained by said SCI color measuring function and an SCE color measurement result obtained by said SCE color measuring function, a second calculation unit for obtaining, from chrominance of said toner image relative to a predetermined reference value, a first component attributed to a glossiness difference in the chrominance and a second component attributed to another factor, based on at least one of said SCE color measurement result and said SCI color measurement result as well as said calculated value, and an adjusting unit for adjusting a control value for a fixing step in said electrophotographic process based on said first component, and adjusting a control value for a step other than said fixing step in said electrophotographic process based on said second component.

2. The image stabilization control system according to claim 1, wherein said first calculation unit obtains said calculated value from a difference between said SCE color measurement result and said SCI color measurement result.

3. The image stabilization control system according to claim 1, wherein said color measuring unit includes an integrating sphere having formed therein a first opening communicating with said medium with said toner image fixed thereon and a second opening communicating with said light source, a detection unit for detecting illuminance of the inner surface of said integrating sphere, and a blocking unit for blocking said specular reflection produced within said integrating sphere from entering said detection unit.

4. The image stabilization control system according to claim 3, wherein said blocking unit includes a light trap arranged on an optical axis produced by the light emitted from said light source being specularly reflected at said medium located at said first opening, and a switching unit for switching between causing light to enter said light trap and causing light to be reflected at said light trap.

5. The image stabilization control system according to claim 1, wherein said adjusting unit changes at least one set value of a fixing temperature, a fixing pressure and a nip width in said fixing step, based on said first component.

6. The image stabilization control system according to claim 1, wherein the step other than said fixing step in said electrophotographic process includes at least one of a charging step, an exposing step, a developing step, and a transfer step, and said adjusting unit changes a parameter corresponding to any step included in the step other than said fixing step.

7. An image forming apparatus comprising:

an image processing unit for executing an electrophotographic process;

a color measuring unit for measuring the color of a toner image after being fixed on a medium; and a control unit, wherein said color measuring unit has an SCE color measuring function of measuring a component excluding specular reflection out of reflected light produced by light emitted from a light source being reflected at said toner image and an SCI color measuring function of measuring said reflected light including said specular reflection, and said control unit includes a first calculation unit for obtaining a calculated value associated with glossiness in said toner image based on an SCI color measurement result obtained by said SCI color measuring function and an SCE color measurement result obtained by said SCE color measuring function, a second calculation unit for obtaining, from chrominance of said toner image relative to a predetermined reference value, a first component attributed to a glossiness difference in the chrominance and a second component attributed to another factor, based on at least one of said SCE color measurement result and said SCI color measurement result as well as said calculated value, and an adjusting unit for adjusting a control value for a fixing step in said electrophotographic process based on said first component, and adjusting a control value for a step other than said fixing step in said electrophotographic process based on said second component.

8. The image forming apparatus according to claim 7, wherein said first calculation unit obtains said calculated value from a difference between said SCE color measurement result and said SCI color measurement result.

9. The image forming apparatus according to claim 7, wherein said color measuring unit includes an integrating sphere having formed therein a first opening communicating with said medium with said toner image fixed thereon and a second opening communicating with said light source, a detection unit for detecting illuminance of the inner surface of said integrating sphere, and a blocking unit for blocking said specular reflection produced within said integrating sphere from entering said detection unit.

10. The image forming apparatus according to claim 9, wherein said blocking unit includes a light trap arranged on an optical axis produced by the light emitted from said light source being specularly reflected at said medium located at said first opening, and a switching unit for switching between causing light to enter said light trap and causing light to be reflected at said light trap.

11. The image forming apparatus according to claim 7, wherein said adjusting unit changes at least one set value of a fixing temperature, a fixing pressure and a nip width in said fixing step, based on said first component.

12. The image forming apparatus according to claim 7, wherein the step other than said fixing step in said electrophotographic process includes at least one of a charging step, an exposing step, a developing step, and a transfer step, and said adjusting unit changes a parameter corresponding to any step included in the step other than said fixing step.

* * * * *